United States Patent [19]

Weiskopf

[11] 4,267,024

[45] May 12, 1981

[54] ELECTROLYTIC COATING OF STRIP ON ONE SIDE ONLY

[75] Inventor: Daniel A. Weiskopf, Bethlehem, Pa.

[73] Assignee: Bethlehem Steel Corporation, Bethlehem, Pa.

[21] Appl. No.: 104,620

[22] Filed: Dec. 17, 1979

[51] Int. Cl.[3] ..... C25D 5/02; C25D 5/08; C25D 7/06

[52] U.S. Cl. ..... 204/15; 204/28; 204/206

[58] Field of Search ..... 204/15, 28, 206

[56] References Cited

U.S. PATENT DOCUMENTS

| | | | |
|---|---|---|---|
| 2,271,736 | 2/1942 | Hall | 204/237 |
| 2,424,173 | 7/1947 | Huston | 204/206 |
| 2,569,577 | 10/1951 | Reading | 204/206 |
| 4,102,772 | 7/1978 | Nakamura | 204/206 |
| 4,183,799 | 1/1980 | Sellitto | 204/DIG. 7 |

*Primary Examiner*—T. M. Tufariello

*Attorney, Agent, or Firm*—Joseph J. O'Keefe; William B. Noll

[57] ABSTRACT

This invention relates to a method and apparatus for electrolytically coating, e.g. zinc or tin, one side only of a horizontally moving flat rolled strip or sheet. More specifically, in the practice of this invention, a cathodically charged flat rolled sheet moves horizontally and contiguously above electrolytic cell body solution, and perforated, submerged, insoluble anode member. Fresh cell electrolyte (plating) solution contained within a solution chamber, under pressure, is continuously fed through said perforations. The cell electrolyte body solution extends to the strip edges, drops off, cascades over the edges of the solution chamber into a catch box, is returned to the recirculation system and pumped into the solution chamber. The flat moving strip, whose bottom surface is being electrolytically coated with metal from said plating solution, serves as a solution deflector and causes the solution flow along the strip edges to extend outward in a flat flow pattern. As a consequence, little or no plating solution contacts the upper or bare strip surface, and metal is not deposited on said upper surface.

8 Claims, 5 Drawing Figures

21
28
S
22
14
28
22
24
20
16
26
18

ELECTROLYTIC COATING OF STRIP ON ONE SIDE ONLY

BACKGROUND OF THE INVENTION

This invention is directed to electrolytically coating of one side only of a horizontally moving flat rolled strip or sheet. More particularly, though not limiting, this invention is directed to a method of and apparatus for electrogalvanizing a continuous ferrous strip.

The forerunner of today's high speed electrolytic plating lines dates back to the early 40's when a Government directive urged installation of electrotinning units to conserve tin. From this evolved the Halogen Tin Process. For a discussion of said process, see *Plating and Surface Finishing,* February, 1976, pages 44–49, an article entitled "Development of the Halogen Tin Process for High Speed Plating of Wide Steel Strip," by E. J. Smithh et al. Additionally there are a number of patents which describe improvements in or modifications to the Halogen process and apparatus for practicing same, note particularly U.S. Pat. Nos. 3,691,049—Eppensteiner et al, 3,645,876—Wilson, 3,264,198—Wells, 2,758,075—Swalheim and 2,569,577—Reading.

A characteristic feature of a high-speed Halogen process, as exemplified by the above noted prior art, is that during high-speed operation, strip drag causes plating solution to pile up and flood the strip at the cell exit end. The cell exit rolls serve as plating solution dams. The dammed plating solution spills out board from the strip pass line and flow, by gravity, along the cell side walls counter to the travel of the strip. Eventually, the plating solution reaches the cell entry end where it spills over a weir.

At high strip line speeds, which may be as high as 610 m/min (2000 ft/min)—E. J. Smith et al article, supra, plating solution overflow begins about midway through the cell and progressively increases until plating begins on the upper surface. That is, edge plating begins when there is sufficient plating solution present to carry current. It will be understood that there is an inherent resistance to plating until the potential across the sheet is overcome. For a high speed plating operation it is difficult to quantify how much plating solution is necessary to overcome the inherent resistance to plate. However, experience has shown that the flooding conditions of the conventional Halogen line are more than sufficient to cause at least edge plating. Thus, the practices represented by the above patents, though several purport to coat only one side (bottom) of a moving strip, suffer the drawback of not fully preventing some coating on the upper surface. Such is obviously not a problem where ultimately both sides of a strip are to be coated. However, where one side of the strip is to remain clean, such as is essentially mandatory for automotive applications, costly procedures must be followed to clean the upper or partially coated surface. The present invention accomplishes the preceding by minimizing contact between the plating solution (electrolyte) and the upper surface. In practice the moving strip serves as a stop or solution deflector and causes said solution to flow along and toward the strip edges to extend outward in a flat flow pattern. This will be described in greater detail hereinafter.

SUMMARY OF THE INVENTION

The invention is directed to a method of and apparatus for electrolytically coating, preferably with zinc, one side only of a continuously moving, horizontally disposed, cathodically charged flat rolled strip or sheet. The apparatus consists of a (a) solution chamber having side walls over which plating solution is caused to flow, (b) catch box underlying said solution chamber, (c) means to replenish the solution chamber with plating solution (electrolyte) from said catch box, (d) anode(s) within said solution chamber to be submerged in the plating solution when said solution chamber is filled in excess of capacity, (e) negatively charged contactor rolls disposed at opposite ends of said solution chamber, and (f) pass line for said strip or sheet which brings same into contact with said contactor rolls and in close proximity to said solution chamber side walls.

In practicing the method of this invention on the above described apparatus, said cathodically charged flat rolled strip moves horizontally above the electrolyte overflowing solution chamber within which is contained the anode(s).

The electrolyte or plating solution is continuously fed, under pressure, from said catch box into said solution chamber such that the capacity of said solution chamber is exceeded and maintained. The excess electrolyte cascades over said side walls of the solution chamber into said catch box. The flat moving strip, whose bottom surface is being electrolytically plated with metal from said electrolyte, serves as an electrolyte stop or deflector and causes said electrolyte to flow along and toward the strip edges to extend outward in a flat flow pattern. By the method and apparatus of this invention, plating solution (electrolyte) in contact with the upper strip surface is minimized, hence, no metal is plated thereon from the plating solution.

DETAILED DESCRIPTION OF PREFERRED EMBODIMENT

Figure 1:
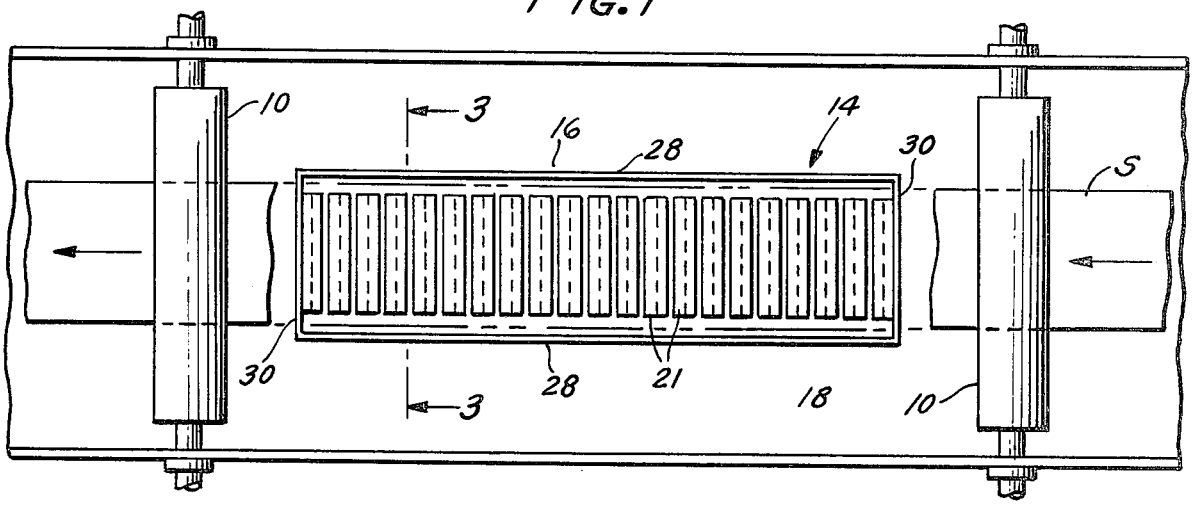
FIG. 1 is a plan view, with the strip to be coated fragmented, of the apparatus for practicing the method according to this invention.

Referring now in detail to the apparatus illustrated in the accompanying drawings, a flat ferrous metal strip S, suitably cleaned for reception of a metallic deposit on the bottom side thereof, is moved, i.e. right to left in FIG. 1, through a plating line. The pass line of said strip is between a series of pairs of rolls consisting of an upper electrically conductive contactor roll 10 (negative polarity) and a lower backup roll 12, the latter formed of a non-conductive material such as neoprene. Below said pass line, between adjacent pairs of rolls 10, 12, are plating cells 14. Typically, a plating line may contain six to eight plating cells, but for convenience only one such plating cell 14 is illustrated in the several FIGURES.

The strip S passes between roll pairs 10, 12 and moves in the direction indicated over cell 14 where the bottom surface of strip S has a layer of protective metal, preferably zinc, deposited thereon.

Figure 5:
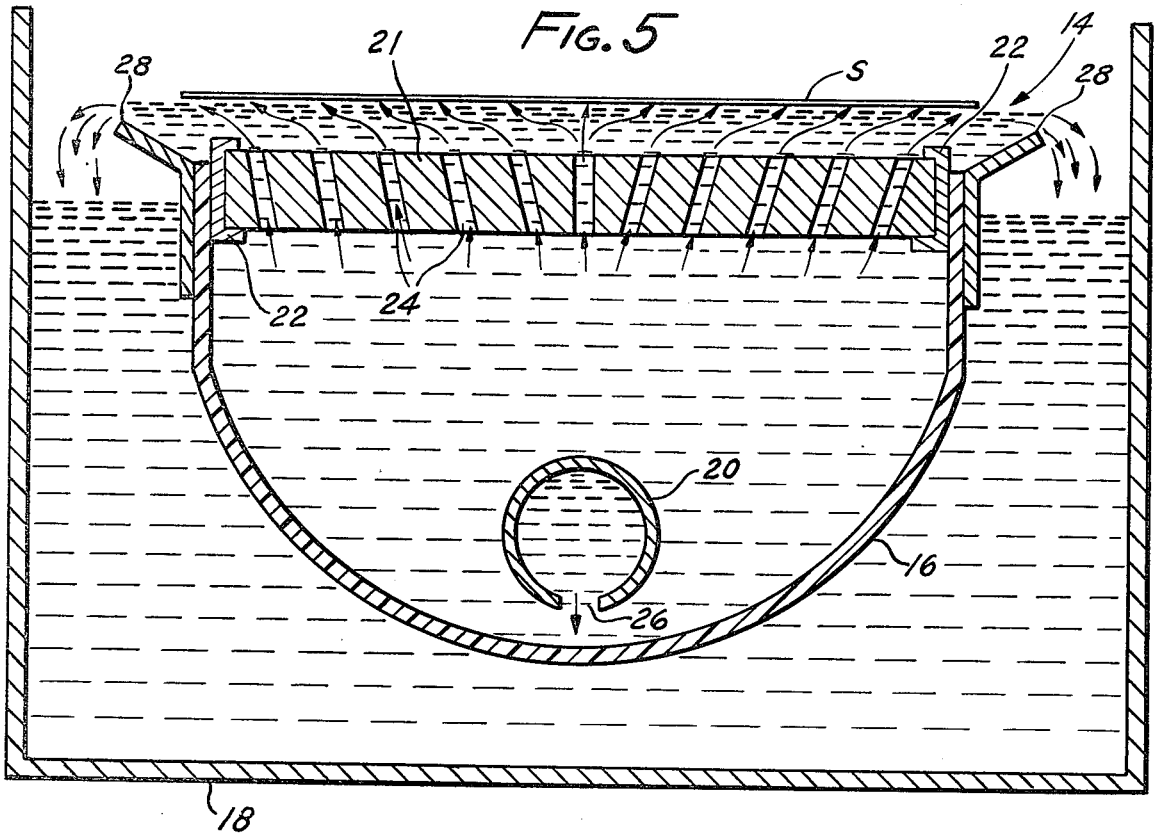
FIG. 5 is a full cross-sectional view, similar to FIG. 3, showing the relationship of the solution chamber to the surrounding catch box for the apparatus according to this invention.

To effect said metal deposition, the electrolyte or plating solution within said cell 14 is caused to flow against strip S. This is accomplished by a cell arrangement which includes as its major components, a solution chamber 16, surrounding catch box 18, plating solution distribution system 20, and solution submerged anodes 21 mounted within positive charged bus bars 22 of FIG. 5.

Figure 4:
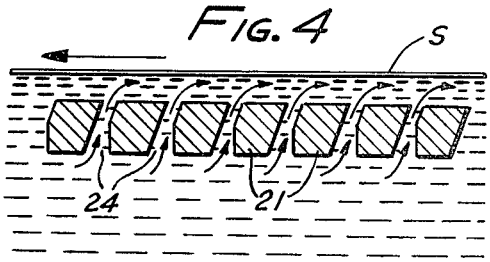
FIG. 4 is a cross-sectional view taken along line 4—4 of FIG. 3.

The anodes 21, typically carbon or lead, are spaced throughout the width of the solution chamber (transverse to movement of strips) to insure a substantially uniform current density across the bottom surface of strip S. Additionally, the anodes 21 are provided with passageways 24 to direct the plating solution (1) foward the edges of strip S (FIG. 5), and (2) in a direction counter to the movement of strip S (FIG. 4).

Figure 2:
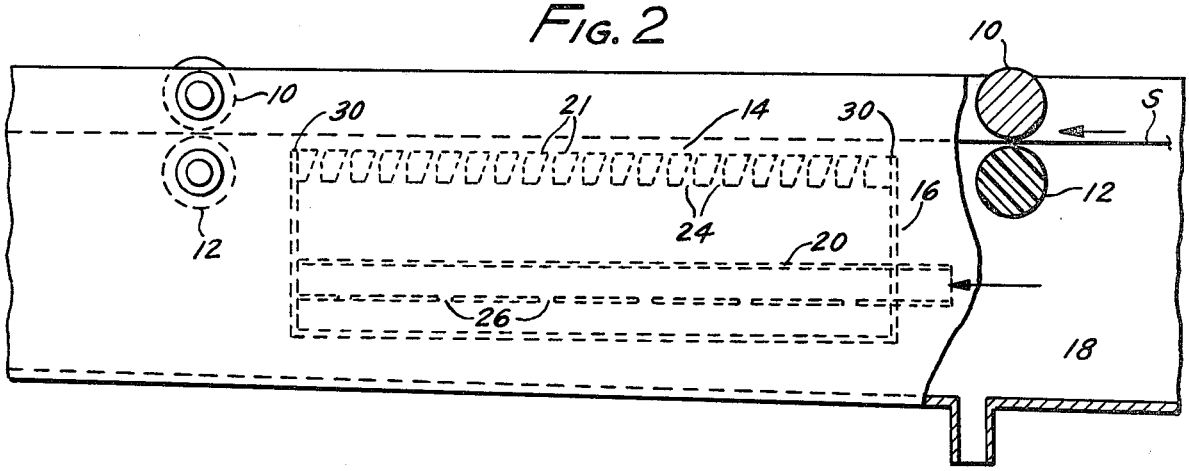
FIG. 2 is a fragmentary side view of the apparatus illustrated in FIG. 1.
Figure 3:
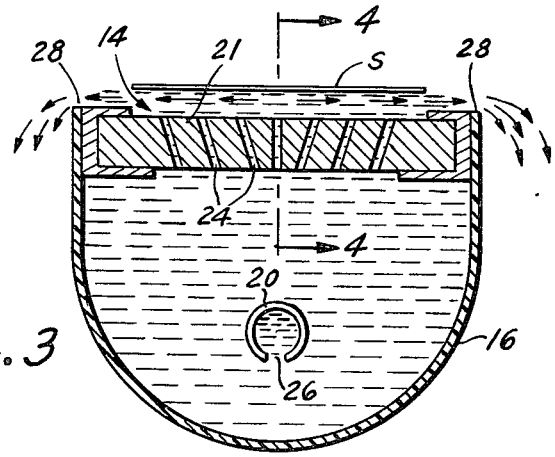
FIG. 3 is a cross-sectional view taken along line 3—3 of FIG. 1.

Fresh plating solution from catch box 18 is pumped through distribution system 20 where the solution exits along slot, or perforations 26 into chamber 16. Placement of the slot, or perforations 26 along the underside of distribution system 20 is preferable as such positioning helps to assure a good solution flow arrangement. While such underside positioning is not critical to the practice of this invention, it is important to provide means, i.e. continuous slot or perforations, to insure uniform distribution of such fresh plating solution throughout the length of the cell 14. The pressure of pumping the plating solution is such as to maintain a quantity of solution in chamber 16 in excess of capacity. That is, plating solution continuously overflows chamber edges 28, 30 (see FIGS. 1 and 2), which edges are in a plane parallel to the pass line for strip S, into catch box 18 for reuse in the plating operation. Additionally, much in the sense of a drinking fountain, the pressure on the replenished plating solution must be sufficient whereby the unrestricted height thereof exceeds the pass line of strip S. As will be described later, the horizontally moving strip S acts as a solution deflector or restraint and causes the solution flow exiting the chamber 16 along strip edges to extend outward from the strip edges in a flat flow pattern. By this arrangement plating solution in contact with the upper surface of strip S is minimized.

Uniformity of metal deposition along the bottom of the strip S depends on the maintenance of sufficient and uniform solution flow into solution chamber 16 by means of the solution distribution system 20. The adequacy of such solution flow will be readily apparent through observation of the solution flow pattern striking the bottom of strip S. That is, the observance of flat flow pattern or an essentially horizontal solution flow from the underside of strip S will indicate sufficient flow for practicing this invention.

With such adequate solution flow, variations in coating weights may be achieved through the addition or deletion of plating cells, changes in strip speed and/or current densities.

To demonstrate the effectiveness of this invention, a series of twelve (12) tests was run for a 12 inch, 0.030 inch strip using different strip speeds and current densities. For these tests a 48 inch long cell containing an 11 inch anode was used. The cell was designed to provide a one inch spacing between the strip pass line and the anode. In addition to the operating parameters above and listed in Table I, certain design features of the solution plating cell included: 2.5 gal. vol., solution flow rate of 100 GPM for a solution change of 40 vol. per minute, and a solution flow rate exiting along strip edges of 0.93 GPM/sq.inch. With the exception of one test, two such plating cells in tandem were used. The uniformity of coating weight, edge to edge, was good considering the testing equipment as shown in the Table. As a laboratory test the results were quite good. Such tests were run under pilot line mechanical conditions which are normally conducive to non-uniform coating distribution. Two notable areas of mechanical problems are strip tracking and strip tension. For example, a lateral shift of the strip will move one edge of the strip away from the underlying anode. Further, if strip tension is not uniform, it is possible that the coating weight along the loose edge will be less. Finally, it will be recalled that fresh plating solution is pumped into the solution chamber. This plating solution pushes against the moving strip causing such strip to lift. This action increases the sheet-anode spacing which correspondingly increases the IR solution drop. Consequently, less current flows and less metal is plated. Thus, even a small non-uniform change in the strip-anode spacing, which may be caused by poor strip shape, uneven strip tension, or misalignment of the strip, will affect coating distribution.

TABLE I

| Sample | Strip Speed (f.p.m.) | Cathodic Current Density (A.S.F.) Cell A | Cell B | Coating Wt. Zn. (oz./sq. ft.) Edge* | Middle | Edge* |
|---|---|---|---|---|---|---|
| 1 | 20 | 350 | 350 | .11 | .11 | .11 |
| 2 | 10 | 350 | 350 | .18 | .18 | .17 |
| 3 | 40 | 350 | 350 | .05 | .05 | .05 |
| 4 | 20 | 375 | 375 | .12 | .12 | .12 |
| 5 | 13.5 | 375 | 375 | .18 | .18 | .18 |
| 6 | 10 | 375 | 375 | .25 | .25 | .24 |
| 7 | 20 | — | 400 | .055 | .07 | .055 |
| 8 | 20 | 375 | 375 | .105 | .12 | .095 |
| 9 | 13.5 | 375 | 375 | .16 | .19 | .15 |
| 10 | 10 | 375 | 375 | .285 | .33 | .275 |
| 11 | 10 | 600 | 600 | .585 | .72 | .585 |
| 12 | 20 | 375 | 375 | .10 | — | .12 |

*1–2 inches from edge

It is contemplated that modifications may be made to this invention, particularly with higher strip speeds, without departing from the spirit and scope thereof. For example, the anodes may be widened to equal the strip width. This would help to compensate for minor strip tracking problems. Increasing strip-anode spacing will minimize the effect of strip sag or an uneven strip. Additionally, such increased spacing help to get away from the "mirror image effect." That is, as the strip is moved closer to the anode there follows the tendency of the strip to be plated in the image or dimension of the anode.

I claim:

1. A process for electrolytically coating one side only of a horizontally moving flat rolled strip with a protective metal, comprising the steps of (a) maintaining the entire upper surface of said strip exposed to the atmosphere while moving said strip along a horizontal path over at least one electrocoating cell, said cell including (1) a solution chamber whose lateral dimension exceeds that of said strip, and whose sides are below said path, (2) means to feed coating solution to said solution chamber, (3) a perforated, insoluble anode disposed within said solution chamber just below said path of said strip, and (4) means for supplying an electro-coating current between said strip and said anode; and (b) continuously feeding coating solution to said solution chamber and maintaining the quantity of solution therein in excess of capacity, whereby by said solution feeding means is such as to cause the coating solution to flow through said perforated anode toward said strip edges and countercurrent to said movement of the strip against said one side of the strip while minimizing contact of said solution with the opposite side of said strip.

2. The process according to claim 1 wherein the coating solution after flowing against said one side of the strip is caused to cascade over the said sides of the solution chamber.

3. Apparatus for electrolytically coating one side only of a flat rolled strip with a protective metal moving in a horizontal path, comprising (a) an electrocoating cell including a solution chamber whose lateral dimension exceeds that of said moving strip to be coated and whose sides are below said path, means for supplying coating solution to said solution chamber, means to define said horizontal path for said moving strip above said solution chamber, an insoluble anode disposed within said solution chamber just below said horizontal path, said anode having perforations angled toward the sides and against the direction of movement of said strip, means for supplying an electrocoating current between said strip and said anode, and (b) means to catch and retain said coating solution exiting from said solution chamber.

4. Apparatus according to claim 3 wherein said means for supplying coating solution to said solution chamber comprises a conduit within said solution chamber having exit ports along the length of said solution chamber to release said coating solution.

5. Apparatus according to claim 4 wherein said solution chamber is semi-circular in cross section.

6. Apparatus according to claim 3 wherein the tops of said sides lie in a plane below and essentially parallel to said strip path.

7. Apparatus according to any one of claims 3 or 4 wherein there are a plurality of electrocoating cells arranged in tandem.

8. Apparatus according to claim 3 wherein said means for supplying coating solution to said solution chamber comprises a conduit within said solution chamber having a continuous slot along the length of said solution chamber to release said coating solution.

* * * * *